US006863118B1

(12) United States Patent
Wang et al.

(10) Patent No.: US 6,863,118 B1
(45) Date of Patent: Mar. 8, 2005

(54) MICRO GROOVED HEAT PIPE

(75) Inventors: Yaxiong Wang, Austin, TX (US); Chung-Yuan Huang, Austin, TX (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/778,701

(22) Filed: Feb. 12, 2004

(51) Int. Cl.[7] ..... F28D 15/00

(52) U.S. Cl. ..... 165/104.26; 165/104.21; 361/700; 29/890.032

(58) Field of Search ..... 165/185, 104.26, 165/104.21, 104.33; 361/700; 29/890.032; 257/714–716; 174/15.2

(56) References Cited

U.S. PATENT DOCUMENTS 3,680,189 A * 8/1972 Noren ..... 29/890.032
4,046,190 A * 9/1977 Marcus et al. ..... 165/104.26
5,179,043 A 1/1993 Weichold et al.
5,219,020 A 6/1993 Akachi
5,259,448 A * 11/1993 Masukawa et al. ..... 165/133
5,465,782 A * 11/1995 Sun et al. ..... 165/104.26
5,527,588 A 6/1996 Camarda et al.
5,598,632 A 2/1997 Camarda et al.
5,642,775 A 7/1997 Akachi
5,697,428 A 12/1997 Akachi
6,227,287 B1 * 5/2001 Tanaka et al. ..... 165/80.4
6,269,866 B1 * 8/2001 Yamamoto et al. .... 165/104.26
6,298,909 B1 * 10/2001 Fukatami et al. ..... 165/133
2003/0136550 A1 * 7/2003 Tung et al. ..... 165/104.26
2004/0069455 A1 * 4/2004 Lindemuth et al. .... 165/104.15

FOREIGN PATENT DOCUMENTS

JP 11-183067 * 12/2001 ..... 165/104.26

* cited by examiner

*Primary Examiner*—Terrell McKinnon
(74) *Attorney, Agent, or Firm*—Wei Te Chung

(57) ABSTRACT

A heat pipe (100) includes a first substrate (102) including a plurality of first low fins (14) and high fins (16), and a second substrate (104) opposing the first substrate and including a plurality of second low fins (14) and high fins (16). A plurality of micro grooves (18) is formed between adjacent fins to form liquid channels (106) of the heat pipe. The first and second high fins are received in corresponding micro grooves of the heat pipe and soldered to the second and first substrates, respectively.

19 Claims, 4 Drawing Sheets

MICRO GROOVED HEAT PIPE

BACKGROUND OF THE INVENTION

1. Field of the Invention

The present invention relates to a heat pipe, and particularly to a micro grooved heat pipe.

2. Related Art

In industry, there are various parts and components that generate heat during operation. For example, in the electronics and computer industries, it is well known that computer components generate heat during operation. Various types of electronic device packages and integrated circuit chips, particularly the central processing unit microprocessor chips, generate a great deal of heat during operation which must be removed to prevent adverse effects on operation of the system into which the device is installed. For example, a PENTIUM microprocessor, containing millions of transistors, is highly susceptible to overheating which could destroy the microprocessor device itself or other components proximal to the microprocessor.

There are a number of prior art methods to cool heat generating components and objects to avoid device overheating. A block heat sink or heat spreader is commonly placed into communication with the heat generating surface of the object to dissipate the heat therefrom. Such a heat sink typically includes a base member with a number of individual cooling members, such as fins, posts or pins, to assist in the dissipation of heat. The geometry of the cooling members is designed to improve the surface area of the heat sink with the ambient air for optimal heat dissipation. The use of such fins, posts of pins in an optimal geometrical configuration greatly enhances heat dissipation compared to devices with no such additional cooling members, such as a flat heat spreader.

It has been discovered that more efficient cooling of electronics can be obtained through the use of passive heat pipes which require no external power source and contain no moving parts. Generally, the heat pipe is in the form a vacuum-tight vessel in a particular geometric shape which is evacuated and partially filled with a working fluid. The heat pipe passively transfers heat from a heat generating component to a heat sink where heat is dissipated. As the heat is conducted into the heat pipe, the fluid is vaporized in an evaporator section creating a pressure gradient in the heat pipe. This forces the vapor to flow along the heat pipe to the condenser section, where the vaporized fluid is condensed and turned back to its fluid state by giving up its latent heat of vaporization. The working fluid is then returned to the evaporator section to repeat the process of removing the heat generated by the heat generating component.

Micro heat pipes are small, wickless heat pipes which have a hydraulic diameter of the same order-of-magnitude as the capillary radius of the working fluid. Liquid transport is accomplished by the formation of a mensiscus of fluid in the corners of the heat pipe due to the surface tension forces of the working fluid.

Current methods of micro heat pipe fabrication typically include forming even channels in an inner circumferential surface of a tube followed by pressing the tube to a flat shape. Another method includes forming even channels in a flat plate followed by folding one part of the plate over the other part of the plate. As illustrated by the above examples, in the formation of the micro heat pipe, it is prone to form protrusions on opposite parts of the flat heat pipe, which reduces heat conduct effect between the heat generating component and the heat pipe. Furthermore, in the use of the heat pipe, when the pressure of the evaporator section of the heat pipe is a little high the two parts of the heat pipe are easy to expand away from each other, which reduces heat dissipation performance of the heat pipe.

SUMMARY OF THE INVENTION

Accordingly, an object of the present invention is to provide a micro grooved heat pipe which can be readily manufactured.

Another object of the present invention is to provide a micro grooved heat pipe which can efficiently dissipate heat from a heat generating component. To achieve the above-mentioned objects, a heat pipe in accordance with the present invention comprises a first substrate comprising a plurality of first low fins and first high fins, and a second substrate opposing the first substrate and including a plurality of second low fins and high fins. A plurality of micro grooves is formed between adjacent fins to form liquid channels of the heat pipe. The first and second high fins are received in corresponding micro grooves of the heat pipe and soldered to the second and first substrates, respectively. Other objects, advantages and novel features of the present invention will be drawn from the following detailed description of a preferred embodiment of the present invention with attached drawings, in which:

DATAILED DESCRIPTION OF THE INVENTION

Figure 1:
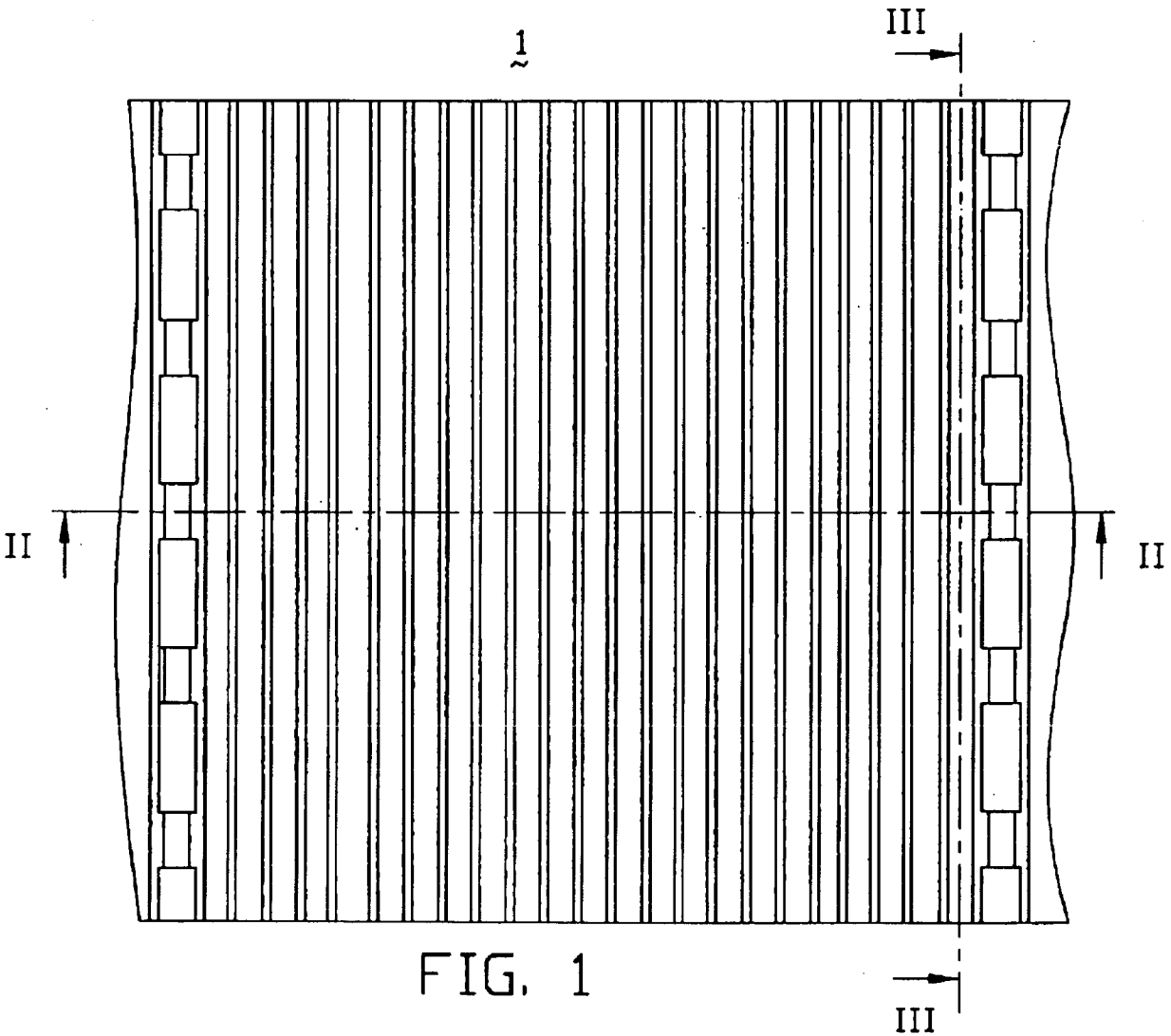
FIG. 1 is a top plan view of one portion of a plate in accordance with a preferred embodiment of the present invention.
Figure 2:
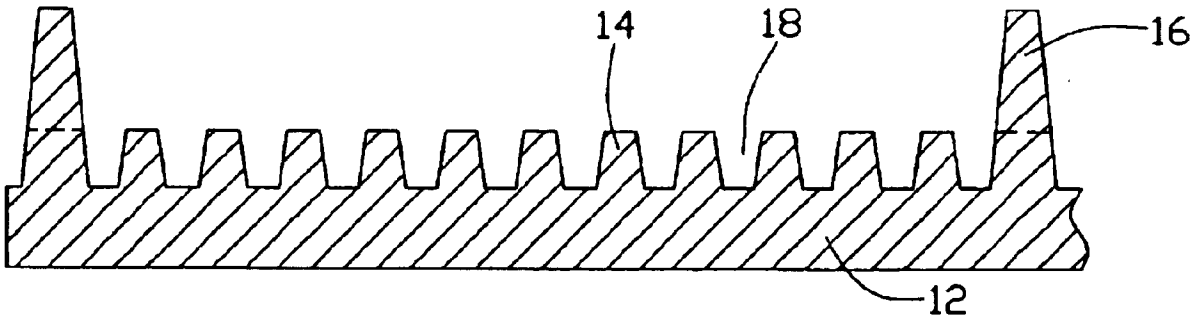
FIG. 2 is a cross-sectional view taken along line II—II of FIG. 1.
Figure 3:
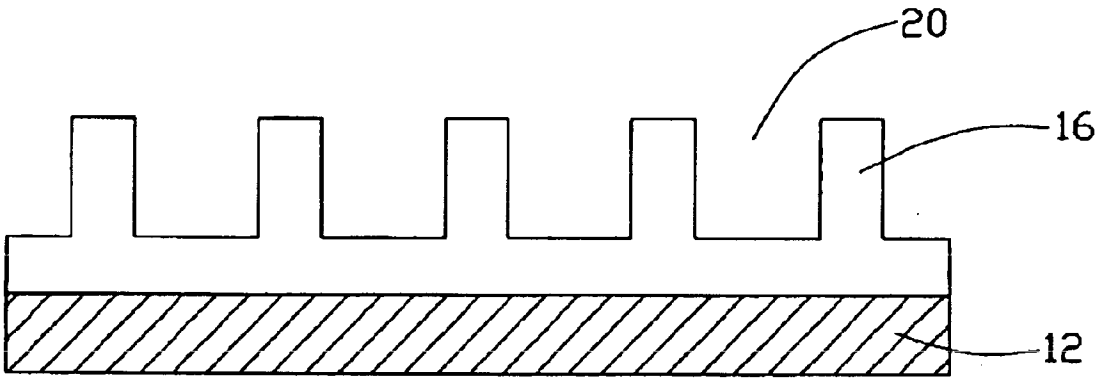
FIG. 3 is a cross-sectional view taken along line III—III of FIG. 1.

FIGS. 1–3 shows a micro grooved plate 1 in accordance with the preferred embodiment of the present invention. The plate 1 comprises a body 12, a plurality of low fins 14 extending upwardly from the body 12, and a plurality of high fins 16 extending upwardly from the body 12, and a plurality of micro grooves 18 formed between adjacent fins 14, 16. The lower fins 14 and high fins 16 interlacedly extend from the body 12. Between each pair of the high fins 16 locates a plurality of lower fins 14. Between each pair of the low fins 14 locates a plurality of high fins 16. A plurality of cutouts 20 is defined in each of the high fins 16. The materials for the plate 1 may be Copper, Bronze, Aluminum, Stainless Steel, Nickel and their alloys. The micro groove 18 may preferably take the cross-sectional shape of a trapezoid. A width of the micro groove 18 may be 0.1–0.5 mm and a height of the micro groove 18 may be 0.1–0.6 mm. Length and width of the plate 1 can be fabricated as long as required.

Figure 4:
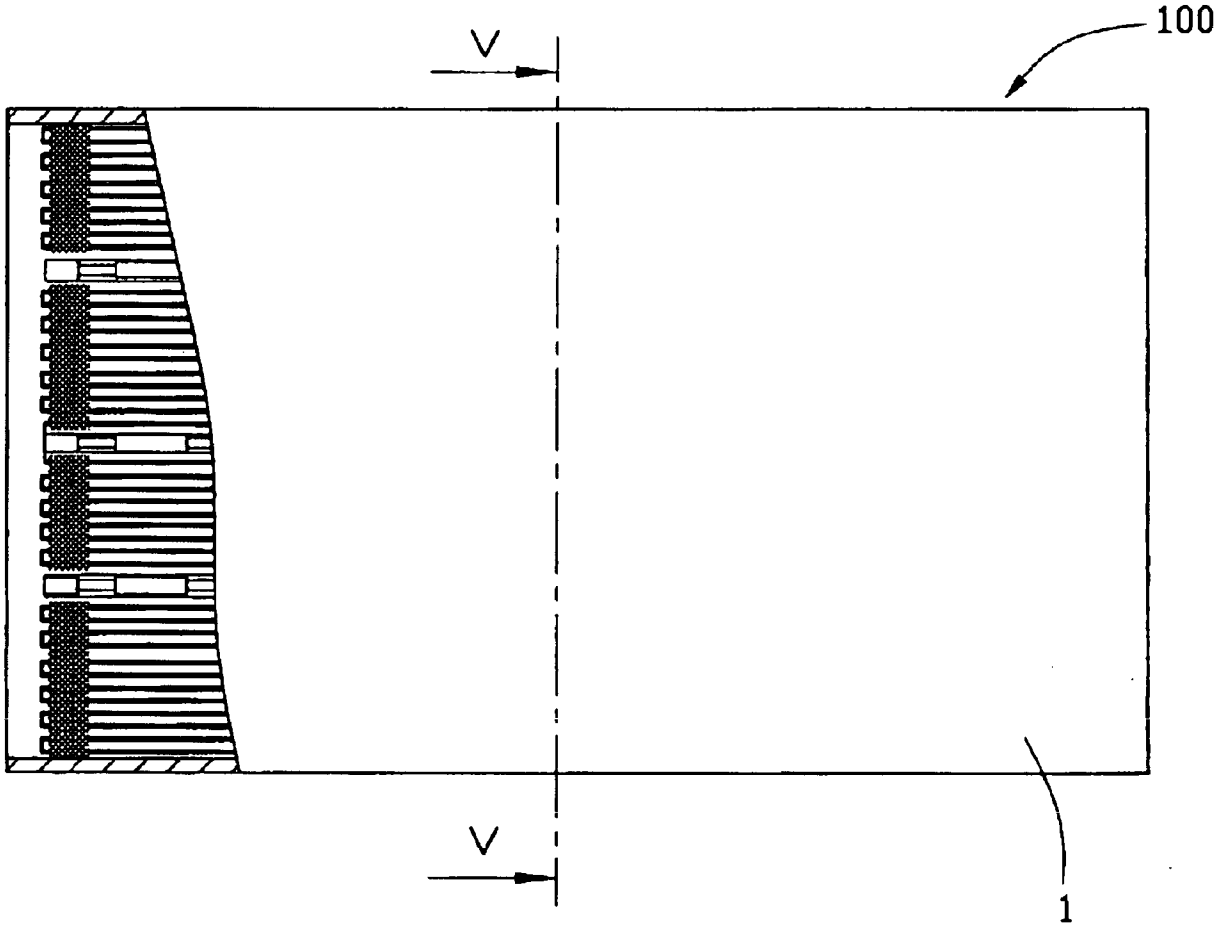
FIG. 4 is a micro grooved heat pipe made of the plate of FIG. 1 with one portion cutaway.
Figure 5:
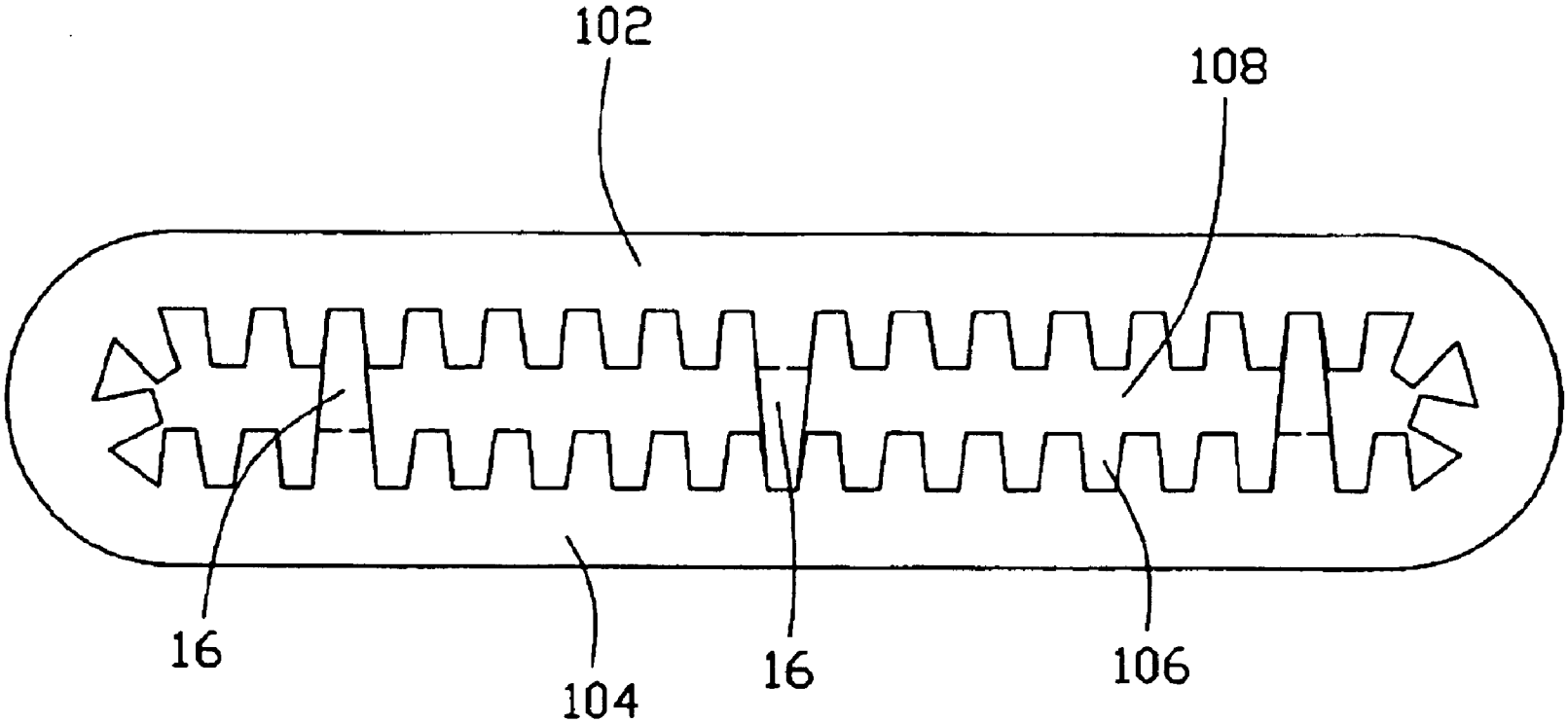
FIG. 5 is a cross-sectional view taken along line V—V of FIG. 4.

FIG. 4 shows a plate-type heat pipe 100 made of the micro grooved plate 1. The heat pipe 100 is made by the following processes: 1) folding one half part of the plate 1 over the other half part of the plate 1, the high fins 16 of said one half part of the plate 1 being received in corresponding micro grooves 18 of said other half part of the plate 1 and the high fins 16 of said the other half part of the plate 1 being received in corresponding micro grooves 18 of said one half part of the plate 1; 2) pressing said one half part toward said the other half part of to cause free ends of the high fins 16 to contact the body 12 of the plate 1; 3) soldering free ends of the high fins 16 to the body 12 in the corresponding micro grooves 18; 4) filling capillary material in opposite ends of the heat pipe 100 to cause the micro grooves 18 of the two half parts of the plate 1 to communicate with one another; 5) sealing said opposite ends of the heat pipe 100. The two half parts of the plate 1 form first and second substrates 102, 104 of the heat pipe 100. The micro grooves 18 of the plate 1 are formed as liquid channels 106 of the heat pipe 100. A vapor space 108 is formed between the two substrates 102, 104 of the heat pipe 100 and sandwiched between the liquid channels 106 of the heat pipe 100. One portion of the vapor space 108 between two high fins 16 communicates with adjacent portions of the vapor space 108 via the cutouts 20.

In the present invention, the high fins 16 of the first substrate 102 of the heat pipe 100 are soldered to the second substrate 104 of the heat pipe 100, which prevent the two subtrates 102, 104 to expand away from each other in process of formation and using of the heat pipe 100.

It is understood that the invention may be embodied in other forms without departing from the spirit thereof. Thus, the present example and embodiment is to be considered in all respects as illustrative and not restrictive, and the invention is not to be limited to the details given herein.

What is claimed is:

1. A heat pipe comprising:

a first substrate comprising a plurality of first low fins and at least one first high fin; and a second substrate opposing the first substrate and comprising a plurality of second low fins and at least one second high fin; wherein a plurality of micro grooves is defined between adjacent fins to form liquid channels and said at least one first and second high fins are received in corresponding micro grooves.

2. The heat pipe as claimed in claim 1, wherein a vapor space is formed between the first and second substrates and sandwiched by the liquid channels of the first and second substrates.

3. The heat pipe as claimed in claim 2, wherein said at least one first and second high fins are soldered to the second and first substrates respectively in the corresponding micro grooves.

4. The heat pipe as claimed in claim 3, wherein the first and second substrates are integrally formed from a metal plate.

5. The heat pipe as claimed in claim 4, wherein capillary material is filled at opposite ends of the heat pipe to cause the liquid channels of the first substrate to communicate with the liquid channels of the second substrate.

6. The heat pipe as claimed in claim 5, wherein each of said at least one first and second high fins defines a plurality of cutouts.

7. A method of forming a heat pipe comprising steps of:

a. providing a plate comprising a body and a plurality of interlaced low and high fins extending from the body, micro grooves formed between adjacent fins;

b. folding one part of the plate over the other part with the high fins of said one part received in corresponding micro grooves of said the other part and the high fins of said the other part received in corresponding micro grooves of said one part;

c. soldering the high fins to the body in the corresponding micro grooves;

d. sealing opposite ends of the plate.

8. The method as claimed in claim 7, further comprising the step of pressing said one part of the plate toward said the other part of the plate to cause the high fins to contact the body of the plate after step b.

9. The method as claimed in claim 8, further comprising the step of filling capillary material at opposite ends of the plate to allow the micro grooves of said one part to communicate the micro grooves of said the other part after step c.

10. A micro grooved sealed plate type heat pipe comprising:

a first body comprising a plurality of low fins and at least one high fin extending from the body;

a second body comprising a plurality of low fins and at least one high fin extending from the body; a plurality of micro grooves are formed between adjacent fins to form liquid flow channels; wherein at least one of said first and second high fins of said first and second bodies are received in corresponding micro grooves.

11. The plate as recited in claim 10, wherein each of the high fins defines a plurality of cutouts.

12. The plate as recited in claim 10, wherein said plate is rolled to form a circumferentially sealed type with two spaced parts opposite to each other, and wherein said spaced parts forms a vapor chamber.

13. The plate as recited in claim 12, wherein there are at least two high fins extending from the body.

14. The plate as recited in claim 13, wherein said at least two high fins are located on said two parts, respectively.

15. A method of making a heat pipe assembly, comprising steps of:

providing a continuous plate extending along a longitudinal direction;

forming a plurality of fins including low fins and high fins on one surface of the plate along a transverse direction perpendicular to said longitudinal direction wherein every adjacent two high fins are spaced from each other by more than one low fins and wherein a plurality of micro grooves are formed between every adjacent two fins, respectively;

cutting a section of said plate with a predetermined length along said longitudinal direction wherein said section includes at least one high fin;

folding said cut section to form two spaced parts opposite to each other in a vertical direction perpendicular to said longitudinal direction and said transverse direction wherein said at least one high fin, which is located one of said two parts, is retainably received in one corresponding micro groove in the other of said two parts under a condition that the low fins of said one of the two parts are spaced from the low fins of the other of the two parts in said vertical direction.

16. The method as claimed in claim 15, wherein every adjacent two high fins are spaced from each other at a same predetermined distance.

17. The method as claimed in claim 15, wherein there are two high fins on each cut section, of which one is formed on the one of said two parts and the other is formed on the other of said two parts, and wherein said one formed on the one of the two parts is received in the corresponding micro groove in the other of the two parts, and the other formed on the other of the two parts is received in the corresponding micro groove in said one of the two parts.

18. The method as claimed in claim 15, wherein a space defined among the low fins of the two spaced parts and said at least one high fin, is filled with working liquid.

19. The method as claimed in claim 18, wherein there are at least two spaces filled with the working liquid.

* * * * *